United States Patent [19]

Guinn et al.

[11] 4,070,981

[45] Jan. 31, 1978

[54] MOORING SYSTEM FOR FLOATING DRILLING VESSELS

[76] Inventors: David C. Guinn; Archie K. Haggard; John P. Thomas, all of P. O. Box 1126, Houston, Tex. 77001

[21] Appl. No.: 729,496

[22] Filed: Oct. 4, 1976

[51] Int. Cl.[2] ..... B63B 21/50

[52] U.S. Cl. ..... 114/293; 114/144 B; 114/200; 254/173 R; 254/187.4

[58] Field of Search ..... 114/144 B, 200, 264, 114/265, 293, 294, 199; 175/7; 254/173 R, 175.7, 187.5, 187.4, 190 R; 242/86.5 R, 86.7, 156, 156.2; 74/520, 577 R, 577 S; 294/84; 188/264 CC

[56] References Cited

U.S. PATENT DOCUMENTS

| | | | |
|---|---|---|---|
| 3,160,850 | 12/1964 | Dudley | 114/144 B |
| 3,756,564 | 9/1973 | Murray et al. | 254/187.5 |
| 3,834,670 | 9/1974 | Pityo | 254/187.4 |
| 3,886,887 | 6/1975 | Cunningham et al. | 114/144 B |
| 3,893,404 | 7/1975 | Chandler et al. | 114/144 B |
| 3,948,201 | 4/1976 | Takeda et al. | 114/144 B |

FOREIGN PATENT DOCUMENTS

| | | | |
|---|---|---|---|
| 835,094 | 5/1960 | United Kingdom | 188/264 CC |
| 882,544 | 11/1961 | United Kingdom | 114/200 |

*Primary Examiner*—Trygve M. Blix

*Assistant Examiner*—Charles E. Frankfort

*Attorney, Agent, or Firm*—Fulbright & Jaworski

[57] ABSTRACT

A mooring system is disclosed for maintaining a ship shape drilling vessel within alignment limits and for warping it into the sea while drilling a well from the vessel in the sub-surface ground below it. The mooring system absorbs all of the forces on the vessel, such as wind, current, wave, swell, roll, pitch, heave, surge and sway. These forces are measured by sensing load on a motor, electric, hydraulic, and the like, driving the anchor chain wildcat while hauling it in, by sensing load on the brake bands for the windlass wildcats, and by sensing load on the chain stopper, which sensed loads are transmitted to a display device which provides sufficient information to maintain the drilling vessel within the alignment limits and to warp it into the sea to minimize forces and motions of the vessel and to avoid beam sea forces. Preferably, a chain counter is provided on the power wildcat which counts the links, and hence the distance, the anchor chain is payed out or hauled in, which is transmitted to the display device. The anchor chains extend from each side both fore and aft of the vessel and each anchor chain has an electric motor driven wildcat, and extends through a chain stopper and fairlead. Vessel alignment is displayed on a cathode ray tube using an acoustic position resonance system.

33 Claims, 13 Drawing Figures

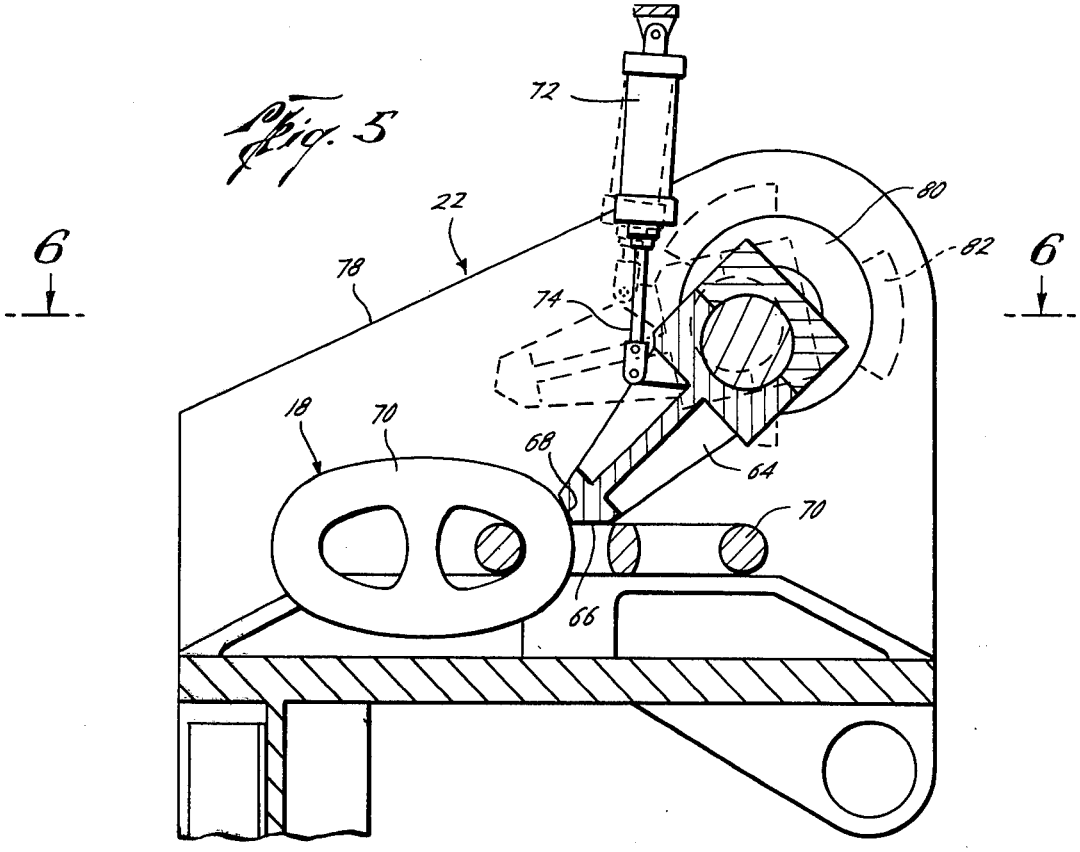
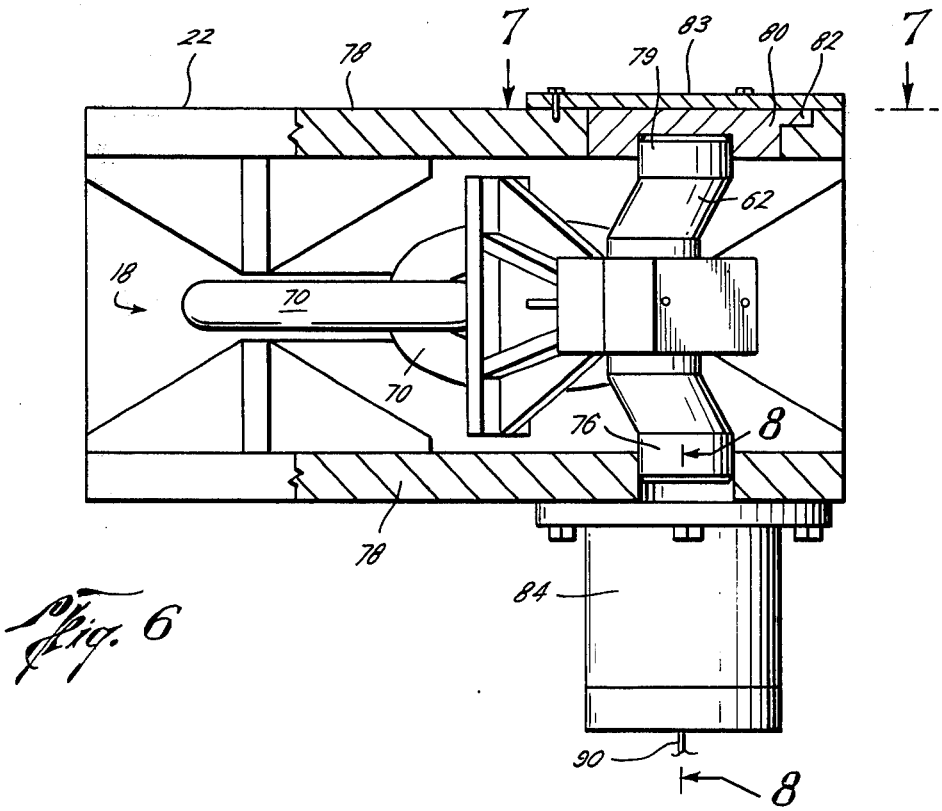
Fig. 6

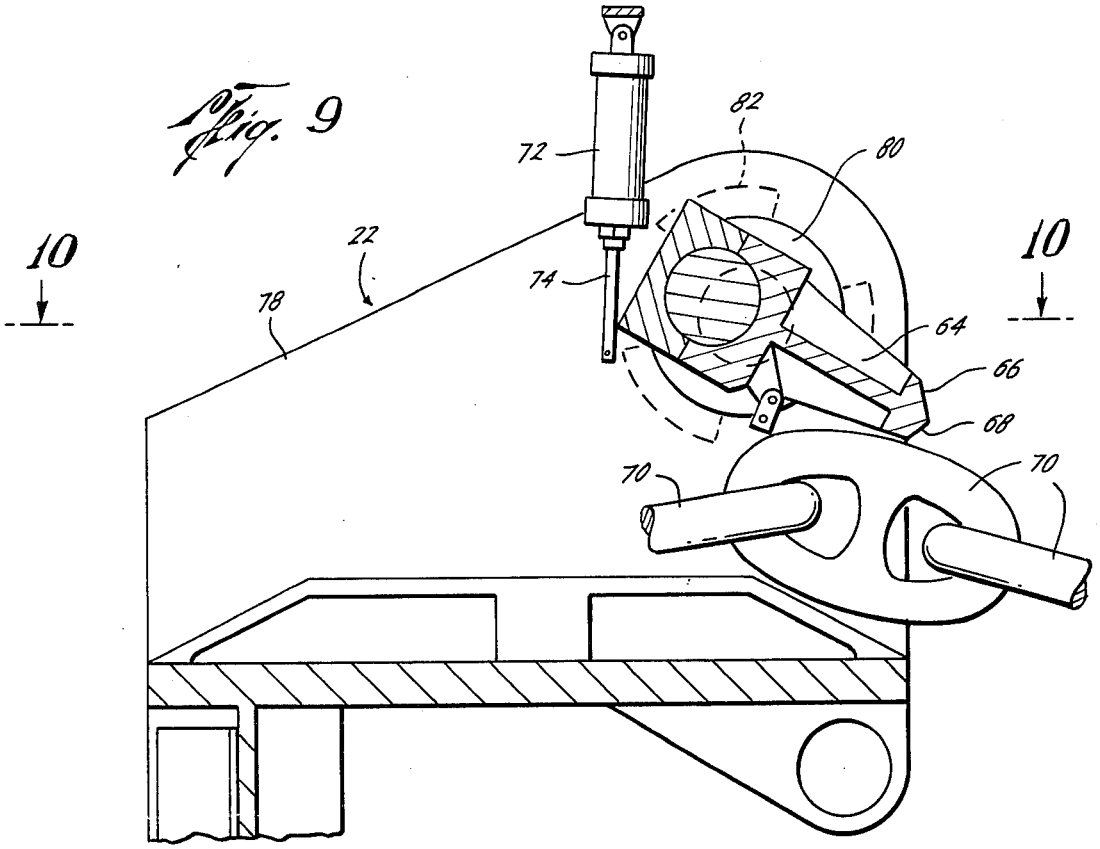
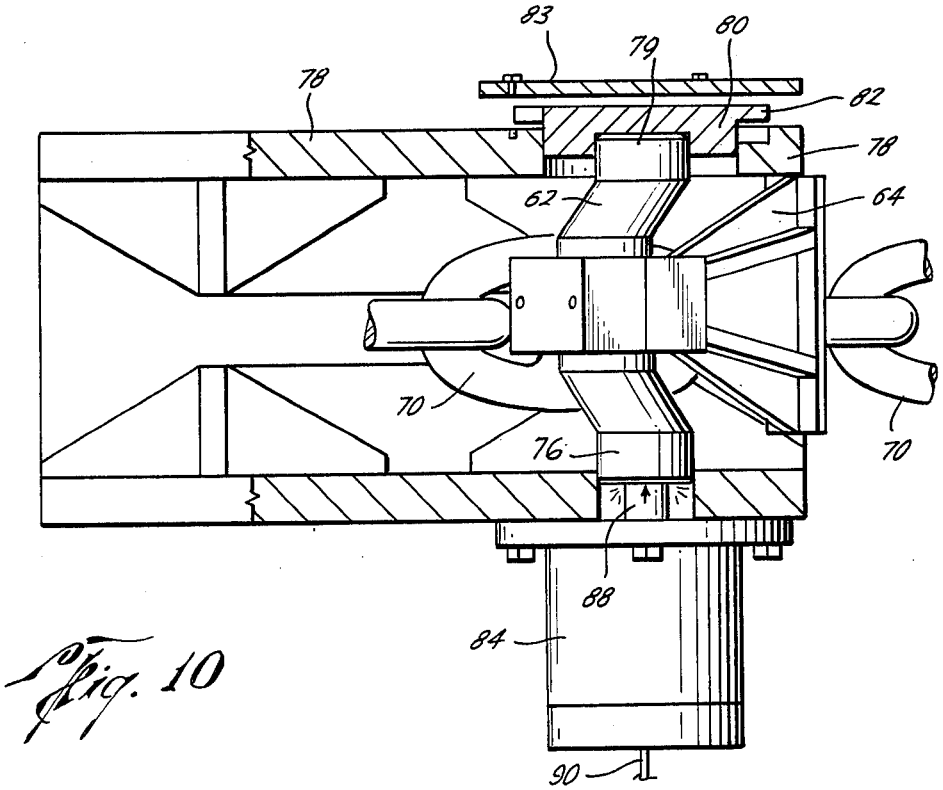
Fig. 10

MOORING SYSTEM FOR FLOATING DRILLING VESSELS

BACKGROUND OF THE INVENTION

As drilling operations are conducted in deeper and deeper water, such as 600 feet and more, it becomes impractical and uneconomical to drill from platforms supported by the underwater ground. These drilling operations are better conducted by floating ship shape vessels and semi-submersibles. The mooring system or station keeping system for ship shape drilling vessels is more critical than for semi-submersibles. A semi-submersible is basically symmetrical; therefore, the forces and motions imparted by wind, wave and current are generally the same regardless of direction; however, the forces, lateral displacements and motions imparted by beam seas are many times greater than those imparted by head seas for ship shape hulls. It is for these reasons that the anchor system for a ship shaped hull must not only correct for lateral displacement as required for semi-submersibles but also have the capability of warping the vessel so as to head it into the sea thus avoiding large lateral displacements, motions and forces encountered in beam seas. While ship shape vessels can move from one location to another at normal ship speeds, which is substantially faster than semi-submersibles, their ship speeds advantage is lost unless there is maximum onstream time of the ship shape hull by the higher theoretical utilization factor of a semi-submersible. It can readily be seen that in order to facilitate operations, increase efficiency and on-stream time, the mooring system should permit maximum flexibility in turning the vessel into the sea and maintaining the vessel within permissible alignment limits over the well.

In addition, there are a number of operational problems in prior mooring systems. For example, brake bands on the windlass wildcats are not cooled and burn up easily in controlling the payout of the anchor chains, since no means are provided, except the brake bands, for this purpose. The chain stoppers cannot be released while under a full load in emergency without severe damage to them. There is inadequate sensing of forces, static and dynamic, which are imparted to the vessel and absorbed by the mooring system including tension read-outs which are critical to the operation of an anchor station keeping system.

The following U.S. patents illustrate various methods and apparatus for mooring floating vessels, anchoring systems, sensing means and other components of mooring systems: Nos. 2,881,591; 2,986,889; 2,987,892; 3,031,997; 3,191,201; 3,279,404; 3,402,687; 3,422,783; 3,536,024; 3,552,343; 3,580,207; 3,601,075; 3,602,175; 3,605,668; 3,613,625; 3,620,181; 3,670,813; 3,702,105; 3,774,562; 3,805,728; and 3,822,663. None of these patents, however, discloses the mooring system of the present invention as well as its improved components and various features by which efficiency and onstream time is increased, maximum flexibility is provided in turning the vessel into the sea and the abovementioned operational problems are minimized.

SUMMARY

Accordingly, the present invention is directed to a mooring system for ship shape floating vessels by which efficiency and on stream time is increased, maximum flexibility is provided in turning the vessel into the sea and operational problems of prior mooring systems are minimized.

The mooring system provides information for maintaining a ship shape drilling vessel within alignment limits while drilling a well from the vessel in the sub-surface ground below it and for warping the vessel into the sea and includes a plurality of mooring chains, at least one extending from each side fore and aft of the vessel, an anchor on each mooring chain for anchoring the anchor chain to the sub-surface ground, an electric motor driven wildcat for each of the anchor chains, including a brake band mounted on a brake drum for braking the wildcat, a chain stopper for each anchor chain operable to lock the chain into position, and a fairlead for each anchor chain at the edge of the vessel, each anchor chain extending from one each of the wildcats through one each of the chain stoppers and the fairleads. Means are provided for sensing load on the motor while hauling in the anchor chain, a sensor is provided on the windlass wildcat brake band which senses load thereon and a sensor is also provided on the chain stopper which senses load thereon. Means are provided for transmitting these sensed loads to a display means and, preferably, a chain counter is provided on each power wildcat which counts the links of the anchor chains as they are payed out and hauled in through the fairlead which is also transmitted to the display means. Since all forces of the sea and the atmosphere are applied against the ship shape vessel, which is moored to the sub-surface ground, all these forces are absorbed by the mooring system. The sensing of the loads, including preferably the anchor chain counting payout or haul in, provides sufficient information so that the ship shape vessel can be maintained within the alignment limits over the well and can be warped into the sea by paying out and hauling in selected ones of the anchor chains except in severe weather conditions when drilling operations are not feasible.

The mooring system includes improvements in the wildlass wildcats, to minimize wear on the electric motor driving them and their brake bands and effective control of the rate of payout of the anchor chains is provided. Catheads are mounted directly behind the windlass wildcats to facilitate payout and hauling in of the mooring lines and anchor chains. The chain stopper has been improved to spread the stresses and load over the pawl engaging the links of the anchor chain and to provide for selective and remote release of the chain stoppers, with a minimum of damage under full load in emergency. A chain counter has been incorporated in the power wildcat to assist in determining the amount of payout or haul in of the anchor chains. Other features and advantages appear throughout the various sections hereof.

Alignment of the vessel over the bore hole is accomplished by using a standard acoustic position performance system having a pinger mounted on the blowout preventer which emits acoustical signals received by an array of transponders mounted on the underside of the vessel. These signals are processed and displayed on a cathode ray tube and are recorded which indicates the position of the vessel over the blowout preventer, and hence the well bore.

It is therefore an object of the present invention to provide a mooring system for ship shape floating vessels by which efficiency and onstream time is increased and maximum flexibility is provided in turning the vessel into the sea.

It is a further object of the present invention to provide a mooring system for ship shape floating vessels in which the operational problems of prior mooring systems and their components are minimized.

A further object of the present invention is the provision of a mooring system which includes effective sensing of forces due to sea and weather by dynamic and static line tension indicators in the mooring system and remote and local controls for operations.

A further object of the present invention is the sensing of loads on haul in by the current to the electric motor driving the windlass wildcats, and sensing loads on the brakes of the windlass wildcats and the chain stoppers.

A further object of the present invention is the provision of improved windlass wildcats in which brake band tension indicators are provided to sense loads and wear and heat of the brake bands is minimized.

A further object of the present invention is the provision of measuring the current to the windlass motors to determine the loads on haul in of the anchor chain.

A further object of the present invention is the provision of improved windlass wildcats in which the motor is rotated only when operating in hauling in the anchor cable, and an overriding clutch is provided to control the rate and speed and payout of the anchor chains rather than by use of the brakebands.

A still further object of the present invention is the provision of chain stoppers which can be remotely and selectively released under load in an emergency thereby avoiding destruction or damage to the chain stoppers.

A further object of the present invention is the provision of such a mooring system in which both dynamic and static indicators sense the wind, wave, and other forces on the vessel through the mooring system.

Other and further objects, features and advantages of the invention appear throughout.

BRIEF DESCRIPTION OF THE DRAWINGS

FIG. 5 is a side view, in section, of the chain stopper.

FIG. 6 is a view of the chain stopper taken along the lines 6—6 of FIG. 5.

FIG. 9 is a side view, in section, of the chain stopper similar to that of FIG. 5, but illustrating the pawl in an emergency released position.

FIG. 10 is a view taken along the line 10—10 of FIG. 9.

DESCRIPTION OF THE PREFERRED EMBODIMENTS

Figure 1:
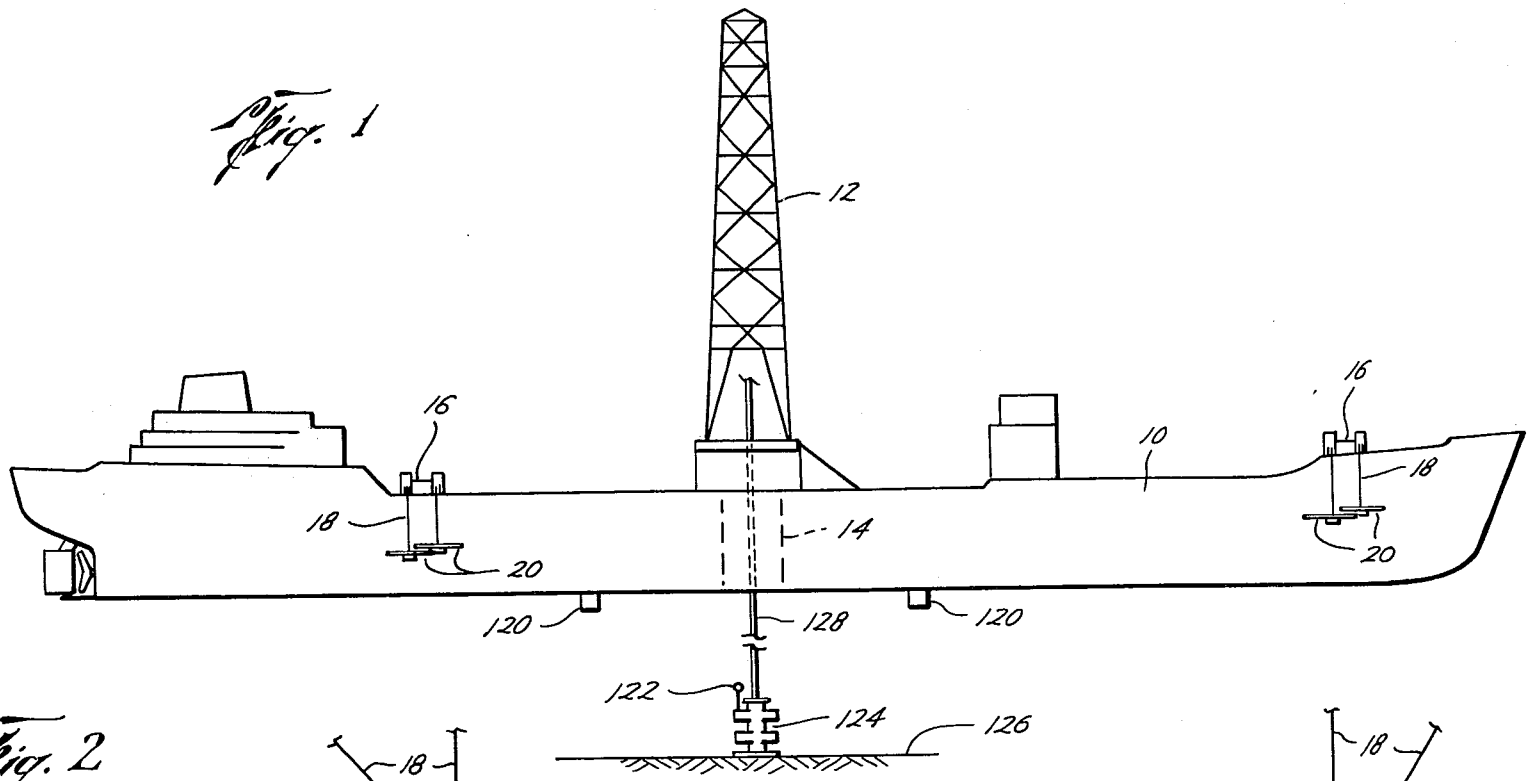
FIG. 1 is a side view of a ship shape drilling vessel provided with a mooring system according to the invention.
Figure 2:
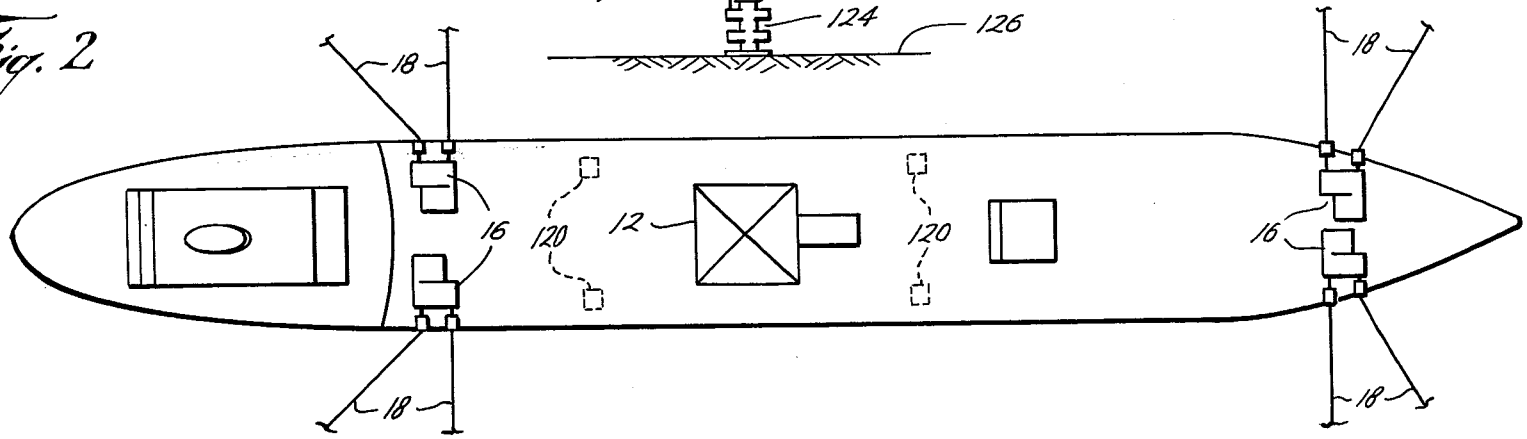
FIG. 2 is a plane view of the ship shape drilling vessel and mooring system of FIG. 1.

Referring now to the drawings, and particularly to FIGS. 1 and 2, a ship shape floating drilling vessel 10 is illustrated which includes the derrick 12 located over the "moon pool" 14, the opening under the derrick 12 through which drilling operations from the floating vessel 10 are conducted into the subsurface land below the sea. Other necessary and desirable drilling components used in the rotary drilling of oil and gas wells are provided, but are not shown. It is essential, however, that during drilling the floating ship shape drilling vessel 10 be maintained in position within the maximum allowable radius of departure for the riser at the top of the blow out preventer, for casing and drill pipe for various diameters, water depth, drilling depth, marine forces and drilling operations, all referred to herein as "alignment limits." In order to maintain the floating ship shape vessel 10 in position, data should be monitored of the wind speed and direction, current speed direction and its depth, wave and swell height, direction and period, roll, pitch, heave, vessel heading, surge and sway. All of these forces are imparted to the ship shape floating vessel 10 and are eventually absorbed by the mooring lines and anchoring system. The catenary formed by the mooring lines does the actual dampening of dynamic motion and absorbs a large portion of the loads. The remaining energy is taken up by the anchors and is ultimately transferred into the soil. Advantageously, sensing of these forces is done through the mooring system of the present invention, which is fed into local and central displays so that the anchor chains can be payed out and hauled in to maintain the vessel within the permissible alignment limits and to warp the vessel into the sea to avoid forces due to beam seas. The alignment of the vessel over the bore hole is accomplished by using an acoustic position performance system which includes an array of transponders mounted beneath the vessel which receives acoustical signals from a pinger mounted on the blowout preventer, which signals are displayed on a cathode ray tube indicating such alignment.

The mooring system comprises either a pair, or preferably double windlasses 16, two aft and two fore (or eight singles, four aft and four fore) which are provided with the anchor lines 18 extending from each side of the ship shape vessel 10 to which are secured the anchors 20. Since each of the mooring lines and their component parts are the same, the same numerals are used to designate the same parts of each of these mooring systems. Preferably, the double windlasses 16, or pairs of windlasses if utilized, should be symmetrical longitudinally with respect to its companion windlass and mooring system on the opposite side of the vessel.

Figures 3, 7, 8:
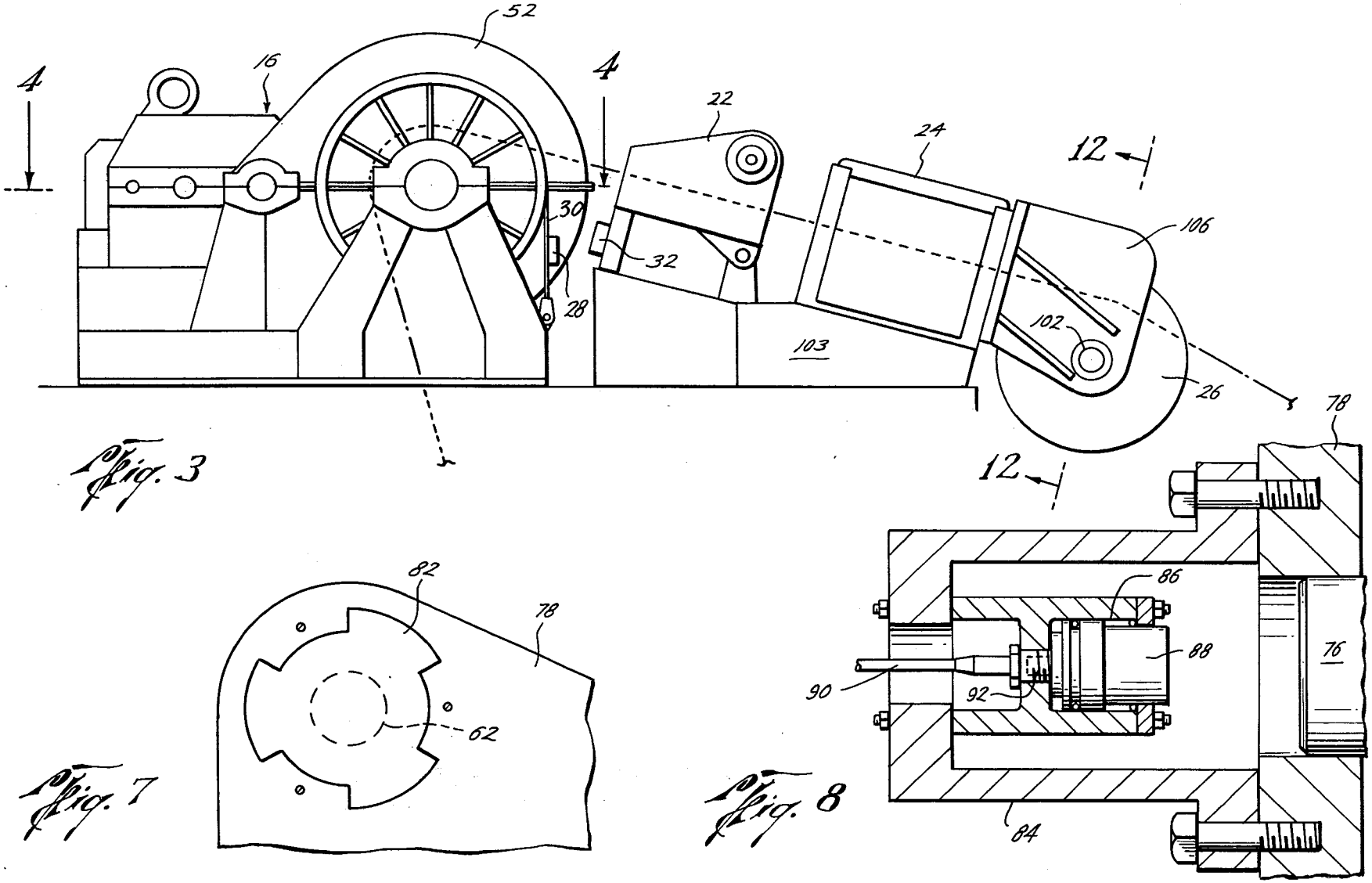
FIG. 3 is a side view of a double windlass, chain stopper and fairlead of the mooring system.
FIG. 7 is a view taken along the lines 7—7 of FIG. 6.
FIG. 8 is a view taken along the lines 8—8 of FIG. 6.

Referring now to FIG. 3, the components for each anchor chain are illustrated. As previously mentioned, there can be either a double windlass for each anchor chain, or a single windlass for each anchor chain, which windlass is designated generally by th referenced numeral 16, a chain stopper 22 and a fairlead 24 having the fairlead wildcat 26 extending over the side of the ship shape vessel 10 through which the anchor chains 18 are lowered into the water and the anchors 20 onto the sub-surface ground.

A sensor 28 is provided on the brake band 30 of the windlass 16 and a sensor 32 is provided on the leg of the chain stopper 22, as illustrated in FIG. 3. The sensors 28 and 32 are directly attached, such as by welding, and the sensors are able to detect both compression and tension and are temperature compensated over a wide range of temperatures encountered in actual use. No detailed description of the sensors is given or deemed necessary since any structural strain sensor may be utilized which will detect full compression and tension under conditions of use as indicated previously and there are a number of them available on the market.

Figure 4:
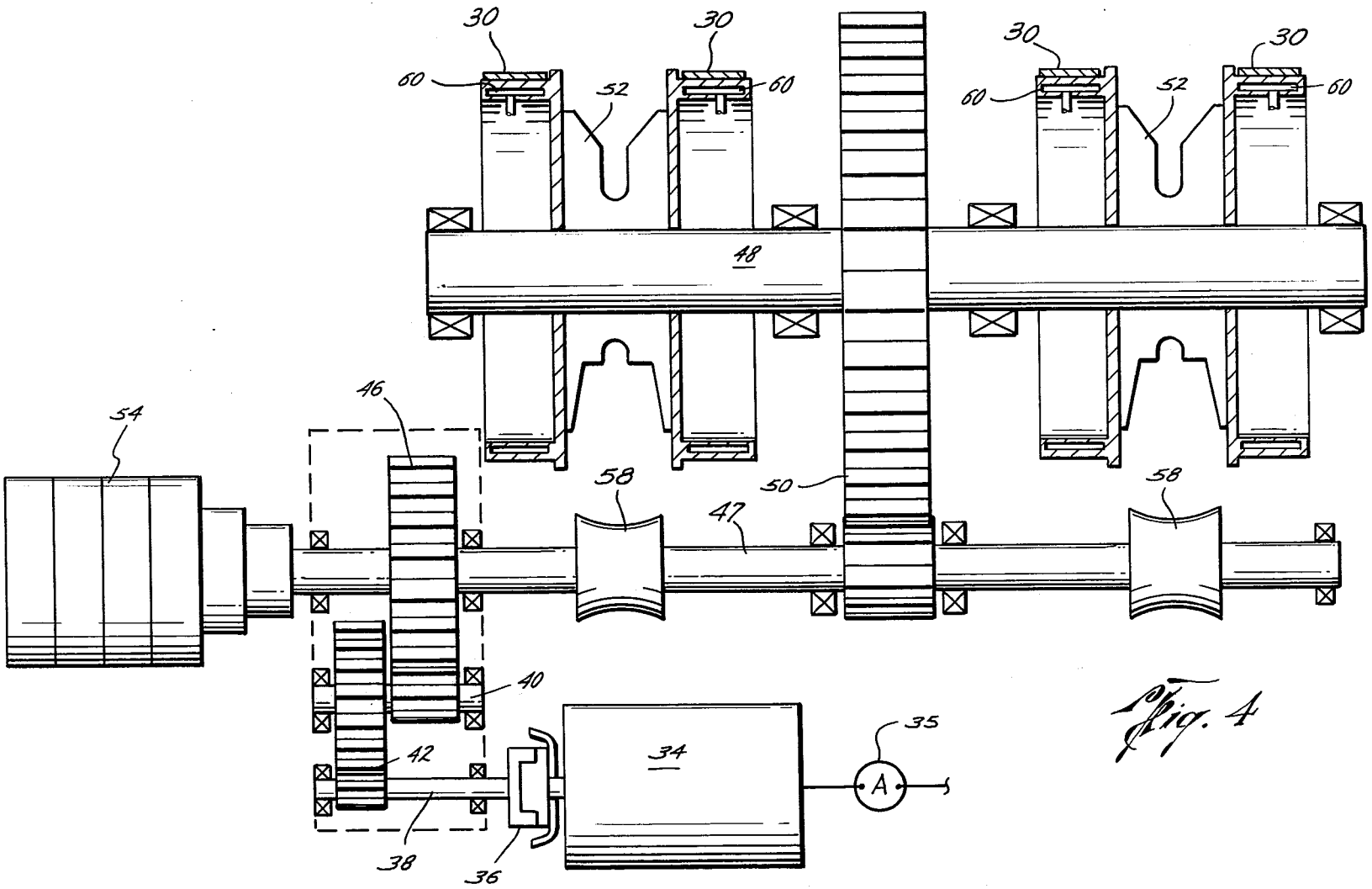
FIG. 4 is a view taken along the line 4—4 of FIG. 3 of the windlass wildcat.

Referring now to the double windlass 16 and particularly to FIG. 4, a double windlass is illustrated which includes a motor, here shown as an electric motor 34, including an ammeter 35 for measuring current to the motor 34 when hauling in the anchor chain 18, gearing which includes the clutch 36 to the output shaft 38, which in turn drives the driven shaft 40 by means of the gearing 42, which driven shaft 40 in turn drives the driven shaft 47 through the gearing 46. The shaft 47 drives the driven shaft 48 through the gearing 50, upon which driven shaft 48 are mounted a pair of windlass wildcats 52, which are drums provided with deep grooves, for the reception of a mooring cable and also the links of a mooring chain attached to the cable, as illustrated. Any type of motor 34, electric, hydraulic and the like can be used including means for sensing the load on the motor while hauling in the anchor chain.

An overriding or braking clutch 54 is provided on one end of the shaft 47 for the purpose of controlling the speed of the wildcats 52 in paying out the anchor chain, rather than by using the brake bands 30, which rapidly burn up due to the intense heat engendered by the extreme loads. While not shown, suitable brake shoes and means to actuate them and the like are provided to coact with the brake bands 56 in the usual manner.

While any type of clutch 36 and overriding clutch 54 may be utilized, mechanical, hydraulic or pneumatic, preferably, however, the clutch 36 is an air clutch, for example a Fawick clutch, and the overriding clutch or braking device 54 is a water brake, also manufactured by Fawick. Thus, depending upon the amount of water placed in the various compartments of the brake 54, the speed of rotation of the shaft 47 and thus the speed of the wildcats 52 is controlled without the use of the brakes 30. Also, by providing the clutch 36 on the electric motor 34, the motor 34 can be disconnected when not hauling in, thus saving considerable wear and tear on the motor 34 which would occur if the motor were rotated through the various gear trains by rotation of the wildcats 52 when paying out the anchor chains. Means for actuating the clutches 36 and 54 are provided, which are not shown.

A further feature of the windlass is the provision of the catheads 58, relatively small drums, mounted on the shaft 47 directly behind the windlass catheads 52. These catheads 56 facilitate handling of the anchor lines and chains by permitting the lightweight pull line or pilot line to be threaded over the wildcat of the fairleads, over the barrel of the fairleads then through the chain stopper and over the windlass wildcat (as will be subsequently described) so that it is relatively easy to retrieve the heavy anchor chain thus enabling fast reconnection of the vessel to its original mooring, when necessary or desired.

A further feature of the windlass arrangement is the provision of cooling of the brake bands 56 by means of cooling chambers, such as the water jackets 60, through which a coolant, such as water, is circulated. This also minimizes the very severe problem of wear on, and actual burning up of, the brake bands 30 in view of the tremendous loads involved when paying out the anchor lines and it is necessary to either stop or reduce the rate of payout of the anchor chains for alignment purposes.

No further details of the windlass assemblies are given, since the other components are conventional.

Chain stoppers are probably responsible for more chain abuse than any other component in mooring systems. In addition, it is necessary in emergency to release the chain under full load. With prior chain stoppers considerable if not complete destruction of the chain stopper occurs when releasing the chain stopper under full load. A feature of the present invention is the provision of a chain stopper which minimizes chain abuse and in which the chain can be released under full load in emergency with a minimal amount of damage to the chain stopper, and in which the chain stoppers may be remotely and selectively actuated and released in emergency. A chain stopper according to the present invention is illustrated in FIGS. 5 - 10.

Referring now to FIGS. 5 and 6, the chain stopper 22 is illustrated which includes an eccentric shaft 62 to which is secured the pawl 64 which is provided with the load engaging tapered faces 66 and 68 which mate with the links 70 of the anchor chain 18 and which taper from the central portion and extend transversely across the width of the chain links 70 so that static, dynamic and shock loads are transmitted to and resisted generally over three surfaces of the chain link 70, rather than making point contact as in previous pawls, guillotines or dogs of chain stoppers. This avoids high localized stress of the pawl and distributes the load thereby minimizing the static, dynamic and shocks loads transmitted to the pawl 64 by the links 70 of the anchor chain 18.

An air or hydraulic ram 72 is provided which is connected by the arm 74 to the pawl 64 which is actuated remotely by means, not shown, so that the pawl can be engaged and disengaged from the links 70 of the anchor chain 18 for normal operations, as shown in dotted lines. The movement of the pawl 64 in disengaging from the links 70 is in a direction opposite to the load thereon. For engagement the movement of the pawl 64 is in the direction of such load.

The eccentric shaft 62 has one end 76 journaled in one of the side members 78 of the chain stopper 22, and has its other end journaled into a releasable connection 80, provided with the lugs 82 (see FIGS. 5 and 7), interfitting in the side member 78, over which releasable connection 80 is provided the cover 83 which is bolted or otherwise secured, such as with shear pins, to the side member 78. Thus, when desired, if an impact is applied to the end 76 of the eccentric shaft 62, the latter will be moved or shifted in the direction of the impact thus causing the releasable connection 80 and its lugs 82 to move out of the side member 78, thus permitting the pawl 64 to shift from its locked position to a point above its contact with the chain length 70, as illustrated in FIGS. 9 and 10. The movement of the pawl 64 is caused by the load of the anchor chain and is in the direction of the load which causes a rupture of the connection of the ram arm 74 with the pawl 64. Thus, the chain stopper can be released under full load in an emergency with a minimum of damage to it.

While the eccentric shaft 62 may be impacted in any desired manner to release it, it is a feature of the present invention to provide impact means which can be remotely and selectively actuated for each chain stopper for each mooring line and anchor chain. For this purpose, an explosive chain stopper impact device 84 is bolted or otherwise secured to the side 78 of the chain stopper over the opening receiving the end 76 of the eccentric shaft 62.

Referring now to FIG. 8, the impact device 84 includes a piston chamber 86, a piston type impactor 88 within the piston chamber 86, and an electric lead 90 to the detonator and explosive assembly 92 so that the impact device 84 can be fired remotely. No more details of the explosive impact device 84 are given as explosive impact or thrust devices are readily available on the market. For example, an explosive chain stopper release, Hi-Shear Model No. SF2112-1 manufactured by the Hi-Shear Corporation of Torrance, Calif. is satisfactory. This thruster, upon electrical actuation, generates pressure to remove a resisting load of up to 600,000 pounds to a distance of at least 0.5 inches.

Referring again to FIGS. 9 and 10, and particularly to FIG. 10, the impactor or thruster 84 has been actuated which drives the cylinder 88 against the end 76 of the eccentric shaft 62 causing the releasable connection 80 and its lugs 82 (as well as the plate 84) to be knocked out of the side member 78 of the chain stopper 22 thereby permitting the load on the anchor chain 18 to move the pawl 64 into the positions illustrated in these figures, which are up and out of the way of the links 70 as best seen in FIG. 9, thereby permitting the anchor chain 18 to be released under full load in an emergency with a minimum of damage to the chain stopper 22.

As previously mentioned, it is an important feature of the mooring system to be able to selectively and remotely actuate the impactors or thrusters 84 attached to each of the chain stoppers 22 for each of the anchor chains 18. Such a remote electrical system is illustrated in FIG. 11 to which reference is now made.

Figure 11:
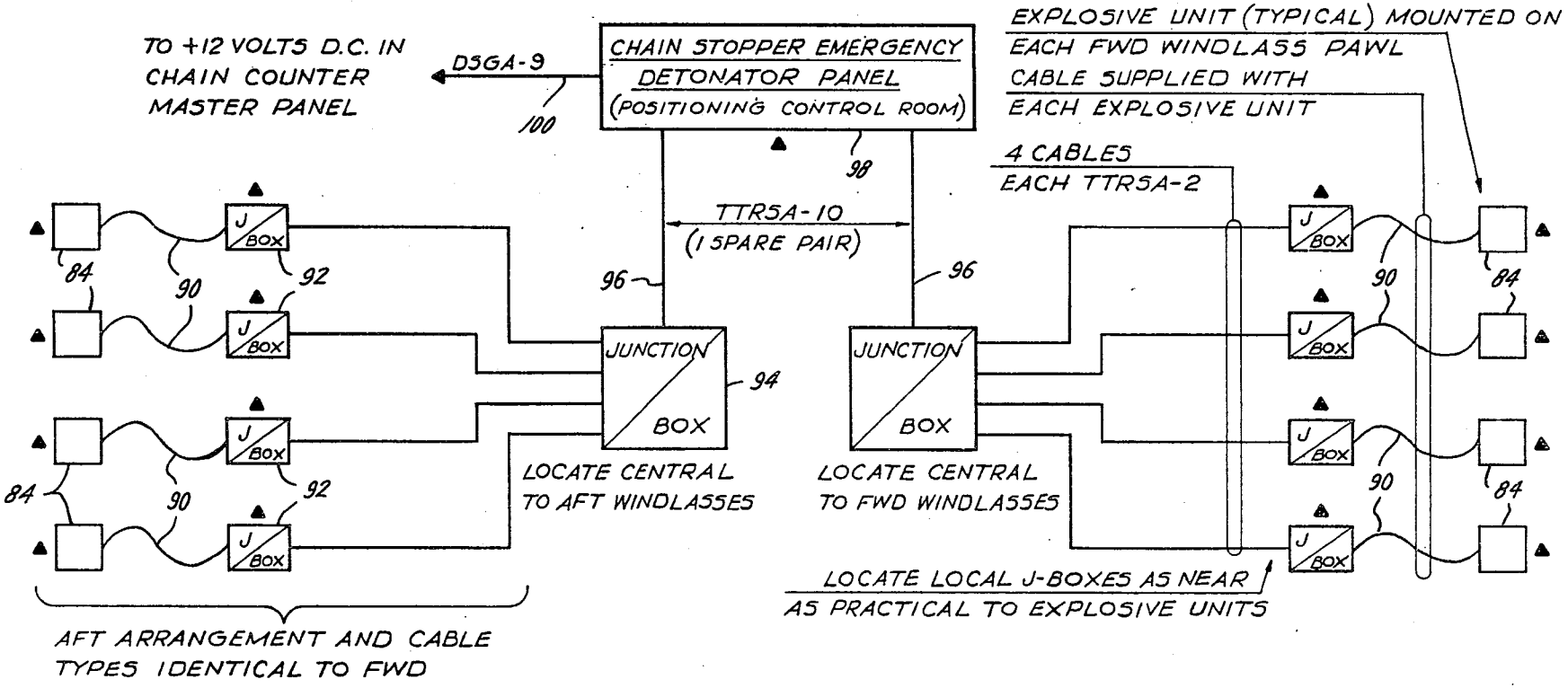
FIG. 11 is a block diagram of an electrical system for remotely and selectively actuating an explosive pawl release.

As illustrated in FIG. 11, each of the electric wire leads 90 are connected through the junction boxes 92 through a central junction box 94, one each being provided for the windlass located aft and another provided for the windlass located fore, with are connected by the electrical lead 96 to the chain stopper emergency detonator panel 98, which preferably is located in the control room of the vessel 10, which panel has the electrical lead 100 extending to a 12 volt direct current source in a chain counter master panel, not shown. Preferably, the electric detonator circuit is of the open type, to prevent inadvertent detonations, and each of the circuits is closed when actuating the particular switch mechanism, not shown, at the detonator panel 98. Since any type of electric circuit can be utilized to selectively and remotely detonate the thrusters or impactors 84, no further description of the electric circuit is deemed necessary or given. The arrangement described and illustrated, however, does permit selective and remote detonation of one or more of the chain stoppers 84 under emergency conditions.

Another area of chain abuse is when the anchor chain 18 goes over the side of the vessel 20. In many instances chocks have been used which cause bending of the links in addition to wear from frictional rubbing due to vessel motion. For a fairlead to be effective, two parameters should be met. The tangent point on its wildcat must be in line with the fleet angle and tangent point of the power wildcat 52 of the windlass 22. In addition, it should have an engagement wrap of at least 45° or a link and a half of anchor chain in any operating position. As best seen in FIG. 3, the fairlead 24 is mounted on a pedestal 103 upon which the chain stopper 22 is mounted and which are in line with the windlass wildcat 52. Thus, the tangent point on the wildcat 26 of the fairlead 24 is in line with the chain stopper 22 and the windlass wildcat 52. Also, although some frictional losses will occur when the anchor chain 18 wraps about the fairlead, these are insignificant when compared to the drop over a chock. Therefore, line tension readings at the power wild cat will be reasonably accurate.

Figure 12:
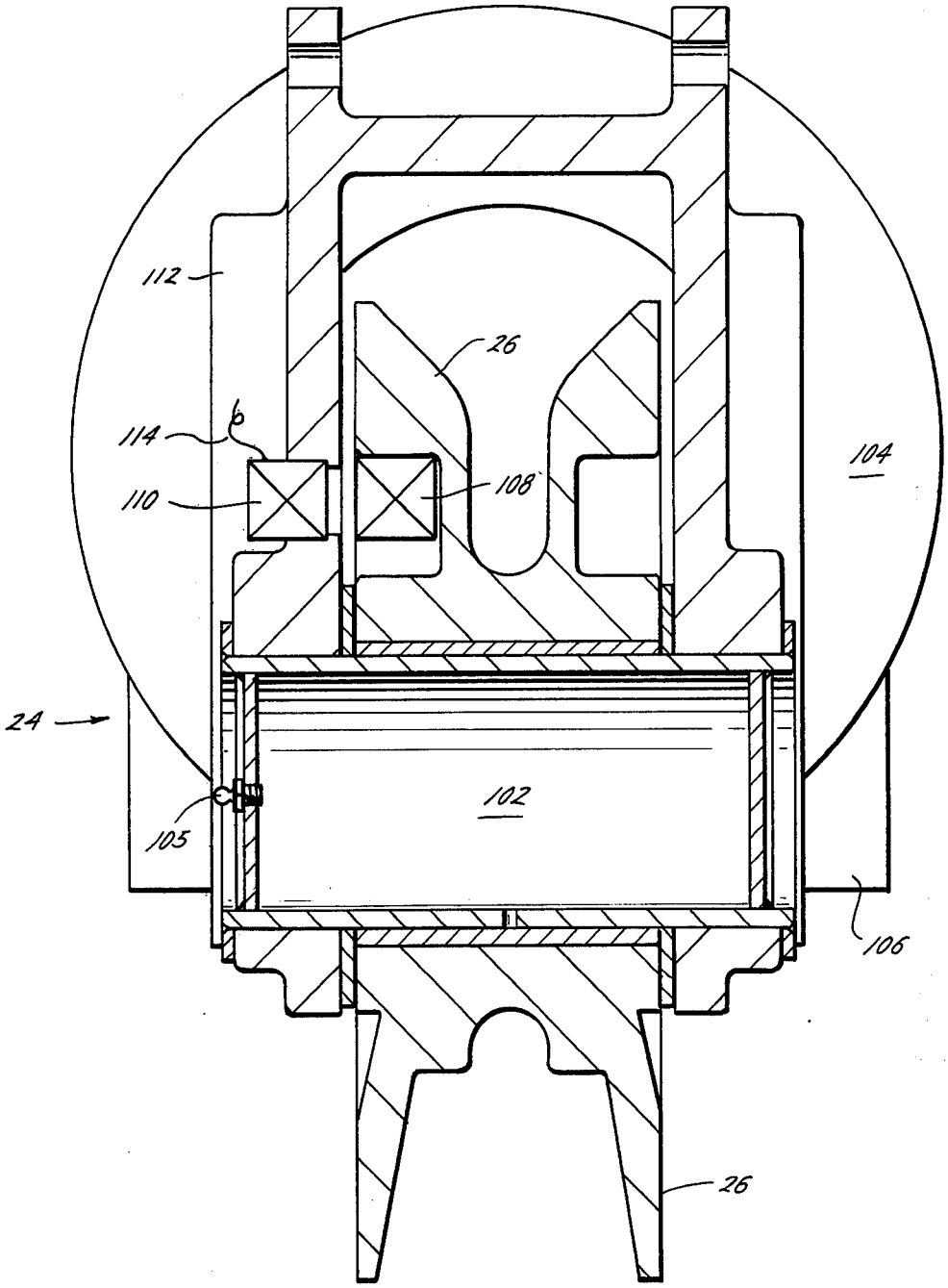
FIG. 12 is a view taken along the line 12—12 of FIG. 3.

The details of the fairlead 24 are best illustrated in FIG. 12, to which reference is now made. The fairlead includes the fairlead wildcat 26, which like the windlass wildcat 52 is in effect a wheel or drum having a shallow and a deep opening for the anchor cable and the anchor chain, not shown in this view. The wildcat 26 is rotatable about the shaft 102, and is mounted on the swivel 104 so that it is free to swivel outwardly of the vessel 10 to facilitate warping into the sea in either direction. Advantageously, the shaft 102 is hollow and has the grease fitting 105 for introduction of lubricant, so that the shaft 102 serves as a lubricant reservoir for its bearing assembly as well as for cooling purposes. Also, the wildcat 26 with its anchor chain and cable grooves is such to permit an engagement wrap with the anchor chain of at least 45° or a link and a half. The wildcat 26, its shaft 102 and its body portion 106 (See FIG. 3) are located over the side of the vessel 10 and are connected to the body portion 110 by means of the swivel disk 104, as previously mentioned, so that the fairlead wildcat 26 can swivel with the anchor chain 18.

Preferably, a chain counter is provided on the fairlead wildcat 26 which counts the links of the anchor chain as it is payed out and hauled in, and hence the distance thereof, to assist in maintaining the vessel within the permissible alignment limits and to warp it into the sea. To this end a magnet 108 is attached to the fairlead wildcat 26, a magnet 110 is attached to the body member 112, and an electric lead 114 extends to a display in the control room (both not shown). Thus, each time the magnet 108 passes the magnet 110, a signal is transmitted to the control room. Since there are a number of counters of various types commercially available on the market, no further description of the chain counter is given or deemed necessary.

Figure 13:
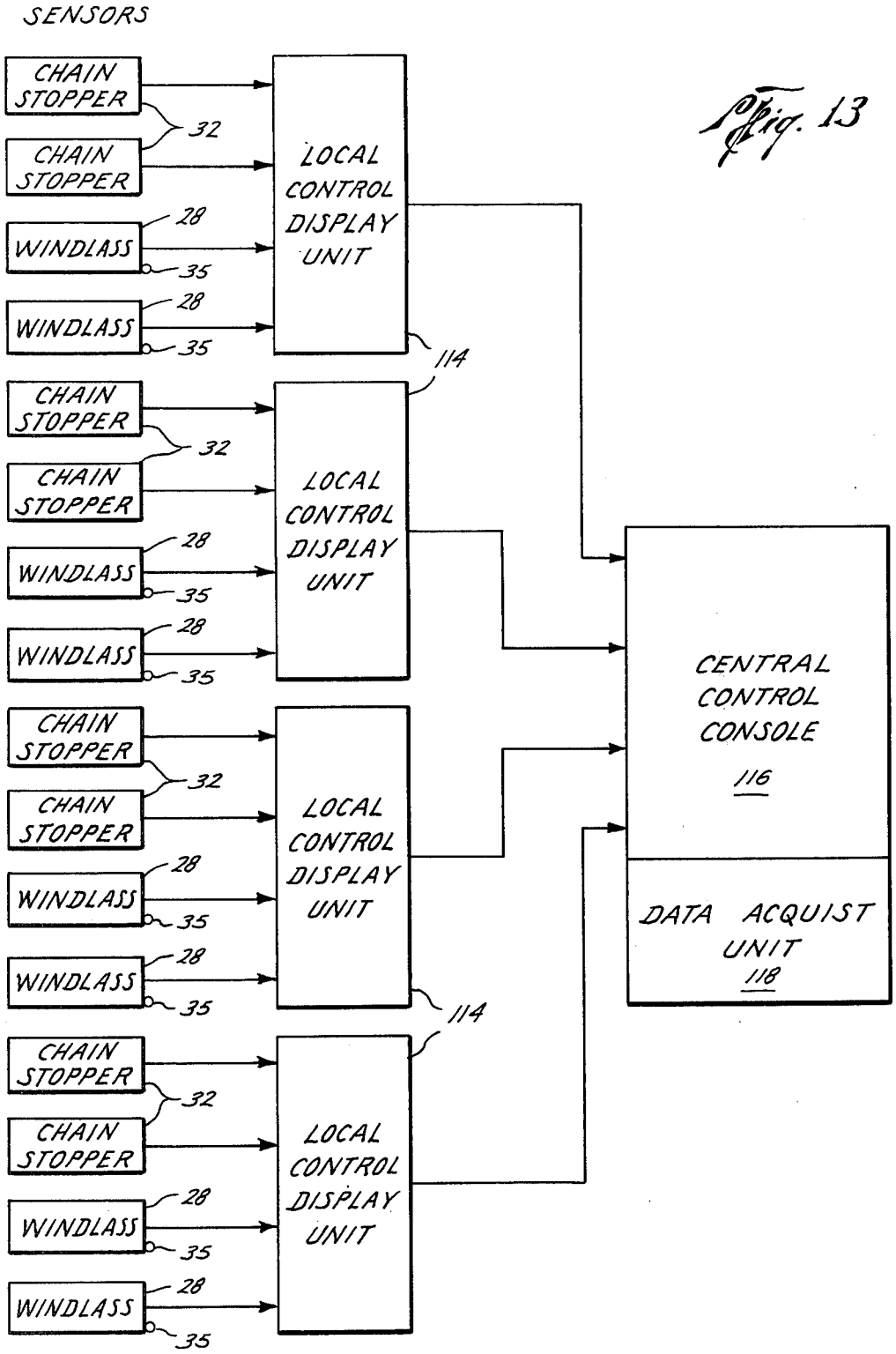
FIG. 13 is a block diagram illustrating means for transmitting sensed loads to display means.

Referring now to FIGS. 1 and 2, means for indicating the alignment of the vessel 10 and the moon pool 14 over the bore hole is illustrated. An array of transponders 120 are mounted on the underside of the vessel 10 around the moon pool 14, here shown as four transponders. An acoustical pinger 122 is mounted on the blowout preventer 124 connected to casing, not shown, extending into the sub-sea ground 126, through which the drill string 128 passes in the usual manner. The pinger 122 emits an acoustical signal which is received by the transponders, which signals are then processed and displayed on a cathode ray tube and recorded in the data acquisition unit 118 (FIG. 13). Since the unit described is a standard acoustic position indicator, no more description thereof is given or deemed necessary.

Referring now to FIG. 13, a block diagram is illustrated for transmitting the loads sensed on the electric motor 34, and the sensors 28 and 32 to a display means, preferably in the control room, not shown. As schematically illustrated here, the input of the sensors of the mooring system are first transmitted to a local control display unit and then to a central control console to provide information for hauling in and paying out the various anchor chains 18 for maintaining the ship shape floating vessel 10 in permissible alignment limits and for warping it into the sea, when required. As illustrated in FIG. 13, for each pair of anchor chains, fore and aft and on each side of the floating vessel 10, the windlass sensor 28 on the brake bands 30 and ammeter 35, and the sensor 32 on the chain stoppers feed information into local control display units 114 for each pair of anchor chains both fore and aft, which loads are transmitted to the central control counsel 116 and data acquisition unit 118. The chain counters assist in paying out or hauling in the desired amount of anchor chains.

Thus, the input from the sensors provides the basic data required for decision making by the crew for repositioning the vessel periodically without interfering with the drilling operation since all of the forces applied against the ship shape vessel 10 are absorbed by the mooring system. The chain counters assist in paying out or hauling in the desired amount of anchor chain. In this connection, for each ship shape vessel, and location, a mathematical analysis should be conducted to establish the maximum allowable radius of departure for the riser extending upwardly from the sub surface ground, not shown, casing and drill pipe for various diameters, the water depth, the drilling depth, the marine forces and drilling operations.

Based upon this data, proper operational steps can be taken in paying out certain of the anchor chains 18 and hauling in others to maintain the derrick 12 within permissible alignment for drilling purposes.

Normally, additional monitoring of the state of the sea and the environment is done to provide additional information and to assist in decision making for alignment purposes. This, of course, is quite helpful, however, the alignment is maintained and the vessel warped into the sea based on the sensed loads of the mooring systems.

Accordingly, the present invention is well suited and adapted to attain the objects and ends and has the advantages and features mentioned as well as others inherent therein.

While presently-preferred embodiments of the invention have been given for the purpose of disclosure, changes may be made in the mooring system which are within the spirit of the invention as defined by the scope of the appended claims.

What is claimed is:

1. A mooring system for maintaining a ship shape drilling vessel within alignment limits while drilling a well from the vessel in the sub-surface ground below it comprising, a plurality of mooring chains, at least one extending from each side fore and aft of the vessel, an anchor on each mooring chain for anchoring the anchor chain to the sub-surface ground, a motor driven wildcat for each of the anchor chains, means for sensing load on the motor while hauling in the anchor chain, a brake including a brake band for braking each wildcat, a first sensor on the brake band sensing load thereon, a chain stopper for each anchor chain operable to lock the chain in position, a second sensor on the chain stopper sensing load thereon, each anchor chain extending from one each of the wildcats through one each of the chain stoppers, load display means, and means for transmitting the loads sensed by the means for sensing load on the motor, and the first and second sensors to the display means, whereby the anchor chains can be let out and hauled in based on the loads sensed thereby maintaining the vessel within the alignment limits and the vessel can be warped into the sea.

2. The mooring system of claim 1 where, a pair of anchor chains extend from each side fore and aft of the vessel.

3. The mooring system of claim 2 where, the wildcats for each pair of anchor chains are driven by a single electric motor, and the means for sensing load on the electric motor is an ammeter.

4. The mooring system of claim 1 including, cutch means arranged to disengage the motor from the wildcat on paying out the anchor chain.

5. The mooring system of claim 1 including, gearing including at least one driven shaft operatively connecting the motor with the wildcat, and braking means on the driven shaft operable to control its rate of rotation and thereby the rotation of the wildcat.

6. The mooring system of claim 5 where, the braking means comprises a water brake.

7. The mooring system of claim 1 where, the brakes include brake drums, upon which the brake bands are mounted, the drums having cooling chambers, and means to provide coolant to the cooling chambers.

8. The mooring system of claim 1 including, counters arranged to count links of each of the anchor chains as they are payed out and hauled in, and means for transmitting the count to the display means.

9. The mooring system of claim 1 including, gearing including at least one driven shaft operatively connecting the motor to the wildcat, said driven shaft being mounted behind the wildcat, and a cathead disposed on the driven shaft directly behind the wildcat.

10. The mooring system of claim 1 where the chain stopper includes, a body through which the anchor chain passes, an eccentric shaft, means journaling the eccentric shaft in the body and arranged to free the shaft on shifting it axially, a pawl secured to the eccentric shaft, means to move the pawl into engagement with links of the anchor chain and to lock it into engagement therewith and to move the pawl out of engagement therewith to free the anchor chain for movement, shifting of the eccentric shaft axially freeing the shaft and the pawl to move with the anchor chain when under load.

11. The mooring system of claim 10 where the chain stopper includes, means to impact an end of the eccentric shaft to shift it axially.

12. The mooring system of claim 11 including, means for remotely and selectively actuating the means to impact the end of the eccentric shaft.

13. The mooring system of claim 10 where, the pawl has a surface for engaging the links of the anchor chain which extends transversely at least as far as the width of the links, and which surface has transversely extending inwardly tapered faces extending from its central portion which substantially mate with the links they engage.

14. The mooring system of claim 1 where the chain stopper includes, a body through which the anchor chain passes, an eccentric shaft, means journaling the shaft in the body and arranged to free the shaft on shifting the shaft axially, a pawl secured to the eccentric shaft, the pawl having a surface for engaging links of the anchor chain, which surface extends transversely at least as far as the width of the links and has transversely extending inwardly tapered faces extending from its central portion which substantially mate with the links they engage, means to move the pawl into engagement with the links of the anchor chain thereby locking it into position and to move the pawl out of engagement therewith to free the anchor chain for movement through the body, means to impact an end of the eccentric shaft to shift it axially, and means for remotely and selectively actuating the means to impact the end of the eccentric shaft thereby shifting it axially and freeing it and the pawl to move with the anchor chain when under load.

15. The mooring system of claim 1 including, a fairlead provided with a hollow shaft forming a reservoir for each anchor chain disposed at the vessel's edge, and means for introducing a lubricant into the reservoir.

16. The mooring system of claim 1 including, a pinger adjacent the well operable to emit acoustical signals, an array of spaced transponders secured to lower portions of the vessel, adapted to receive the acoustical signals, and means operable to display signals from the transponders as an indication of alignment of the vessel over the well.

17. A mooring system for maintaining a ship shape drilling vessel within alignment limits while drilling a well from the vessel in the subsurface ground below it comprising, a plurality of mooring chains, at least one extending from each side fore and aft the vessel, an anchor on each mooring chain for anchoring the anchor to the subsurface ground, an electric motor driven wildcat for each of the anchor chains, a brake including a brake band for each wildcat, a chain stopper for each anchor chain operable to lock the chain in position, a fairlead for each chain at the edge of the vessel, each anchor chain extending from one each of the wildcats through one each of the chain stoppers and the fairleads, means for sensing load on the electric motor while hauling in the anchor chain, a first sensor on the brake band sensing load thereon, a second sensor on the chain stopper sensing load thereon, a counter on each fairlead arranged to count links of each of the anchor chains as they are payed out and hauled in through the fairlead, load and counter display means, and means for transmitting the load sensed by the means sensing the load on the electric motors, the first and second sensors, and the count of the counters to the display means, whereby the anchor chains can be let out and hauled in based on the loads sensed and count made thereby maintaining the vessel within the alignment limits and the vessel can be warped into the sea.

18. The mooring system of claim 17 where, a pair of anchor chains extend from each side fore and aft of the vessel.

19. The mooring system of claim 18 where, the wildcats for each pair of anchor chains are driven by a single electric motor.

20. The mooring system of claim 17 including, clutch means arranged to disengage the electric motors from the wildcats on paying out the anchor chains.

21. The mooring system of claim 17 including, gearing including at least one driven shaft operably connecting the electric motor with the wildcat, and braking means on the driven shaft operable to control its rate of rotation and thereby the rotation of the wildcat.

22. The mooring system of claim 21 where, the braking means comprises a water brake.

23. The mooring system of claim 17 where, the brake includes a brake drum upon which the brake band is mounted, the drum having a cooling chamber, and means to provide coolant to the cooling chamber.

24. A windlass for paying out and hauling in a mooring line comprising, a wildcat, an electric motor, means operably connecting the electric motor with the wildcat including clutch means arranged to disengage the electric motor from the wildcat on paying out the mooring line, the means including, at least one driven shaft, and braking means on the driven shaft operable to control its rate of rotation and thereby the rotation of the wildcat.

25. The windlass of claim 24 where, the braking means comprises a water brake.

26. The windlass of claim 24 including, a brake drum on the wildcat, a brake band mounted on the brake drum, the drum having a cooling chamber, and means to provide coolant to the cooling chamber.

27. The windlass of claim 24 where, the driven shaft is mounted behind the wildcat, and a cathead is mounted on the driven shaft directly behind the wildcat.

28. The windlass of claim 24 where, the driven shaft is mounted behind the wildcat, a cathead is disposed on the driven shaft directly behind the wildcat, and includes additional braking means on the wildcat including a brake drum and a brake band mounted on the brake drum, the drum having a cooling chamber, and means to provide coolant to the cooling chamber.

29. A chain stopper for stopping and locking in position an anchor chain comprising, a body through which the anchor chain passes
an eccentric shaft,
means journaling the eccentric shaft in the body and arranged to free the shaft on shifting it axially,
a pawl secured to the eccentric shaft,
means to move the pawl into engagement with links of the anchor chain and to lock it into engagement therewith and to move the pawl out of engagement therewith to free the anchor chain for movement,
shifting the eccentric shaft axially freeing the shaft and the pawl to move with the anchor chain when under load.

30. The chain stopper of claim 29 where the chain stopper includes,
means to impact an end of the eccentric shaft to shift it axially.

31. The chain stopper of claim 30 including,
means for remotely and selectively actuating the means to impact the end of the eccentric shaft.

32. The chain stopper of claim 29 where,
the pawl has a surface for engaging the links of the anchor chain which extends transversely at least as far as the width of the links, and
has transversely-extending inwardly tapered portions extending from its central portion which substantially mate with the links they engage.

33. A chain stopper for stopping and locking in position an anchor chain comprising,
a body through which the anchor chain passes,
an eccentric shaft,
means journaling the shaft in the body and arranged to free the shaft on shifting the shaft axially,
a pawl secured to the eccentric shaft,
the pawl having a surface for engaging links of the anchor chain, which surface extends transversely at least as far as the width of the links and has transversely-extending inwardly tapered faces extending from the central portion which substantially mate with the links they engage,
means to move the pawl into engagement with the links of the anchor chain thereby locking it into position and to move the pawl out of engagement therewith to free the anchor chain for movement through the body,
means to impact an end of the eccentric shaft to shift it axially, and
means for remotely and selectively actuating the means to impact an end of the eccentric shaft thereby shifting it axially and freeing it and the pawl to move with the anchor chain when under load.

* * * * *

UNITED STATES PATENT OFFICE

CERTIFICATE OF CORRECTION

Patent No. 4,070,981 Dated January 31, 1978

Inventor(s) David C. Guinn, Archie K. Haggard, John P. Thomas

It is certified that error appears in the above-identified patent and that said Letters Patent are hereby corrected as shown below:

Column 1, line 32, delete the hyphen in "on-stream"

Column 7, line 40, change "with" to --which--

Column 10, line 17, change "cutch" to --clutch--

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*